US005811194A

United States Patent [19]

Kurze et al.

[11] Patent Number: 5,811,194

[45] Date of Patent: Sep. 22, 1998

[54] METHOD OF PRODUCING OXIDE CERAMIC LAYERS ON BARRIER LAYER-FORMING METALS AND ARTICLES PRODUCED BY THE METHOD

[75] Inventors: Peter Kurze, Düren; Dora Banerjee, Kerpen; Hans-Jürgen Kletke, Düren, all of Germany

[73] Assignee: Electro Chemical Engineering GmbH, Zug, Switzerland

[21] Appl. No.: 662,265

[22] Filed: Jun. 7, 1996

Related U.S. Application Data

[60] Continuation of Ser. No. 318,976, Oct. 6, 1994, abandoned, which is a division of Ser. No. 982,092, Nov. 25, 1992, Pat. No. 5,385,662.

[30] Foreign Application Priority Data

Nov. 27, 1991 [DE] Germany ..... 41 39 006.7

[51] Int. Cl.[6] ..... B32B 15/04

[52] U.S. Cl. ..... 428/469; 428/472; 428/472.1; 428/472.2

[58] Field of Search ..... 428/469, 472, 428/472.1, 472.2, 332

[56] References Cited

U.S. PATENT DOCUMENTS

| | | | |
|---|---|---|---|
| 3,643,658 | 2/1972 | Steinemenan | 428/472 |
| 3,954,512 | 5/1976 | Kanter | 428/472.2 |
| 4,111,763 | 9/1978 | Pryor | 428/472 |
| 4,898,651 | 2/1990 | Mahmoud | 204/29 |
| 4,976,830 | 12/1990 | Schmeling et al. | 204/58.4 |
| 5,075,178 | 12/1991 | Schmidt | 428/660 |
| 5,225,069 | 7/1993 | Haupt | 205/325 |
| 5,266,412 | 11/1993 | Bartak | 428/472 |
| 5,385,662 | 1/1995 | Kurze | 205/316 |

FOREIGN PATENT DOCUMENTS 91267864 4/1991 Germany .

*Primary Examiner*—Timothy M. Speer
*Attorney, Agent, or Firm*—Cohen, Pontani, Lieberman & Pavane

[57] ABSTRACT

A method of producing oxide ceramic layers on Al, Mg, Ti, Ta, Zr, Nb, Hf, Sb, W, Mo, V, Bi or their alloys by a plasma-chemical anodical oxidation in a chloride-free electrolytic bath having a pH value of 2 to 8 and a constant bath temperature of −30° to +15° C. A current density of at least 1 A/dm$^2$ is maintained constant in the electrolytic bath until the voltage reaches a predetermined end value.

15 Claims, No Drawings

METHOD OF PRODUCING OXIDE CERAMIC LAYERS ON BARRIER LAYER-FORMING METALS AND ARTICLES PRODUCED BY THE METHOD

This is a continuation of application Ser. No. 08/318,976, filed Oct. 6, 1994, now abandoned which is a divisional of Ser. No. 07/982,092 Nov. 25, 1992 which has matured into U.S. Pat. No. 5,385,662 issued Jan. 31, 1995.

BACKGROUND OF THE INVENTION

1. Field of the Invention

The present invention relates to a method of producing oxide ceramic layers on barrier layer-forming metals or their alloys by plasma-chemical anodic oxidation in aqueous organic electrolytes, wherein the oxide ceramic layer may be further modified for specific applications. The present invention further relates to articles produced by the method.

2. Description of the Related Art

In aqueous electrolytes, the anodic oxidation described above is a gas/solid reaction under plasma conditions in which the high energy input at the base point of the discharge column produces liquid metal on the anode which forms with the activated oxygen a temporarily molten oxide. The layer formation is effected by partial anodes. The spark discharge is preceded by a forming process (P. Kurze; Dechema-Monographien Volume 121-VCH Verlagsgesellschaft 1990, pages 167–180 with additional literature references). The electrolytes are selected in such a way that their positive properties are combined and high-quality anodically produced oxide ceramic layers are formed on aluminum. By combining different salts, higher salt concentrations can be achieved in the electrolytic bath and, thus, higher viscosities can be achieved. Such high viscosity electrolytes have a high thermal capacity, they stabilize the oxygen film formed on the anode and, thus, they ensure a uniform oxide layer formation (DD-WP 142 360).

Because of the pattern of the current density/potential curves for the anodic spark discharge, the distinct portions can be distinguished, i.e. the Faraday portion, the spark discharge portion and the arc discharge portion, see P. Kurze mentioned above.

A barrier layer is naturally found on the metal or the metal alloy. By increasing the voltage of the anodically poled metal, the barrier layer increases. Consequently, a partial oxygen plasma which forms the oxide ceramic layer is created at the phase boundary metal/gas/electrolyte. The metal ion in the oxide ceramic layer is derived from the metal and the oxygen from the anodic reaction in the aqueous electrolyte. The oxide ceramic is liquid at the determined plasma temperatures of approximately 7,000° Kelvin. Toward the side of the metal, the time is sufficient for allowing the melted oxide ceramic to properly contract and, thus, form a sintered oxide ceramic layer which has few pores. Toward the side of the electrolyte, the melted oxide ceramic is quickly cooled by the electrolyte and the gases which are still flowing away, particularly oxygen and water vapor, leave an oxide ceramic layer having a wide-mesh linked capillary system. Pore diameters of 0.1 $\mu$m to 30 $\mu$m were determined by examinations using electron scan microscopes (Wirtz, G. P., et al., *Materials and Manufacturing Processes,* 1991, "Ceramic Coatings by Anodic Spark Deposition," 6(1):87–115, particularly FIGURE 12).

DE-A-2 902 162 describes a method in which spark discharge during the anodizing process is utilized for manufacturing porous layers on aluminum intended for use in chromatography.

EP-A-280 886 describes the use of the anodic oxidation with spark discharge on Al, Ti, Ta, Nb, Zr and their alloys for manufacturing decorative layers on these metals.

The above-described methods make it possible only to manufacture ceramic layers having relatively small thicknesses of up to a maximum of 30 $\mu$m which are insufficient for use as wear and corrosion protection layers.

SUMMARY OF THE INVENTION

Therefore, it is the object of the present invention to produce oxide ceramic layers on the above-mentioned metals which have a substantially greater layer thickness of up to 150 $\mu$m, are resistant to abrasion and corrosion and have a high alternating bending strength.

In accordance with the present invention, oxide ceramic layers are produced on aluminum, magnesium, titanium, tantalum, zirconium, niobium, hafnium, antimony, tungsten, molybdenum, vanadium, bismuth or their alloys by plasma-chemical anodic oxidation while maintaining the following parameters:

1. The electrolytic bath should be substantially free of chloride, which means that it contains less than $5\times10^{-3}$ mol/l chloride ions;
2. The electrolytic bath is adjusted to a pH value of 2 to 8;
3. The temperature of the bath is in the range of −30° to +15° C. and preferably between −10° and +15° C.;
4. The temperature of the bath is maintained constant within the limits of ±2° C.; and
5. The current density of at least 1 A/dm$^2$ is maintained constant until the voltage reaches an end value.

DESCRIPTION OF THE PREFERRED EMBODIMENT

Within the scope of the present invention, aluminum and its alloys are very pure aluminum and, inter alia, the alloys AlMn; AlMnCu; AlMg1; AlMg1,5; E-AlMgSi; AlMgSi0,5; AlZnMgCu0,5; AlZnMgCu1,5: G-AlSi-12; G-AlSi5Mg; G-AlSi8Cu3; G-AlCu4Ti; G-AlCu4TiMg.

For the purposes of the invention, also suitable in addition to pure magnesium are the magnesium casting alloys with the ASTM designations AS41, AM60, AZ61, AZ63, AZ81, AZ91, AZ92, HK31, QE22, ZE41, ZH62, ZK51, ZK61 EZ33, HZ32 as well as the wrought alloys AZ31, AZ61, AZ 80, M1, ZK60, ZK40.

Moreover, pure titanium or also titanium alloys, such as, TiAl6V4; TiAl5Fe2,5, etc. can be used.

The chloride-free electrolytic bath may contain inorganic anions which are conventional in methods for the plasma-chemical anodic oxidation, namely, phosphate, borate, silicate, aluminate, fluoride or anions of norganic acids, such as, citrate, oxalate and acetate.

The electrolytic bath preferably contains phosphate ions, borate ions and fluoride ions in combination and in an amount of at least 0.1 mol/l of each individual of these anions up to a total of 2 mol/l.

The cations of the electrolytic bath are selected in such a way that they form together with the respective anions salts which are as soluble as possible in order to facilitate high salt concentrations and viscosities. This is usually the case in alkali-ions, ammonium, alkaline earth ions and aluminum ions up to 1 mol/l.

In addition, the electrolytic bath contains urea, hexamethylenediamine, hexamethylenetetarine, glycol or glycerin in an amount of up to a total of 1.5 mol/l as stabilizer.

For producing particularly wear-resistent oxide ceramic layers on aluminum or its alloys by plasma-chemical anodic oxidation at a current density of at least 5 A/dm$^2$ which is maintained constant until the voltage reaches an end value, it is possible to utilize even very significantly diluted electrolytic baths of the above-described composition in which the concentration of the anions is only 0.01 to 0.1 mol/l. In these significantly diluted baths, the pH value is between 10 and 12, preferably 11. Because of the low conductivity of this electrolytic bath, the voltage end value may reach up to 2000 V. The energy input caused by the plasma-chemical reaction is accordingly very high. The oxide ceramic layer formed on the aluminum materials consists of corundum, as was shown by X-ray diffraction examinations. A hardness of the oxide ceramic layer of up to 2000 HV is obtained. These oxide ceramic layers can be particularly used where an extremely high abrasive wear protection is required.

The selection of the type of voltage and current, such as, direct current, alternating current, 3-phase current, impulse current and/or interlinked multiple-phase current with frequencies of up to 500 Hz has surprisingly no influence on the process of forming ceramic layers on the metals.

The current supply to the plasma-chemical anodizing process for forming the ceramic layer is carried out in such a way that the required current density of at least 1 A/dm$^2$ is maintained constant and that the voltage is applied until a predetermined end value is reached. The voltage end value is between 50 and 400 volts and is determined by the metal used, i.e. by the alloy components of the metal, by the composition of the electrolytic bath and by the control of the bath.

As mentioned above, the invention also relates to articles produced by the above-described method, wherein the articles are of barrier layer-forming metals or their alloys with plasma-chemically produced oxide ceramic layers having a thickness of 40 to 150 $\mu$m, preferably 50 to 120,$\mu$m.

The following examples describe the present invention in more detail without limiting the scope of the invention.

EXAMPLE 1

A test plate of AlMgSi1 having a surface area of 2 dm$^2$ is degreased and subsequently washed with distilled water.

The test plate treated in this manner is plasmachemically anodically oxidized in an aqueous/organic chloride-free electrolytic bath having the following composition.

| | |
|---|---|
| (a) Cations | 0.13 mol/l sodium ions |
| | 0.28 mol/l ammonium ions |
| (b) Anions | 0.214 mol/l phosphate |
| | 0.238 mol/l borate |
| | 0.314 mol/l fluoride |
| (c) Stabilizer and complex forms | 0.6 mol/l hexamethylenetetramine |

With a current density of 4 A/dm$^2$ and an electrolyte temperature of 12° C.±2° C. After a coating time of 60 minutes, the voltage end value of 250 volts is reached.

The test plate with ceramic layer is washed and dried. The thickness of the ceramic layer is 100 $\mu$m. The hardness of the ceramic layer is 750 (HV 0.015).

EXAMPLE 2

A dye cast housing of GD-AlSil2 having a surface area of 1 dm$^2$ is treated for one minute at room temperature in a pickle composed in equal halves of 40% HF and 65% $HNO_3$ and the housing is subsequently washed with distilled water.

The dye cast housing pickled in this manner is plasma-chemically anodically oxidized in the aqueous/organic chloride-free electrolytic bath of Example 1 at a current density of 8 A/dm$^2$ and an electrolyte temperature of 10° C.±2° C. After a coating time of 30 minutes, a voltage end value of 216 volts is registered.

The dye cast housing with ceramic layer is washed and dried.

The thickness of the ceramic layer is 40 $\mu$m.

EXAMPLE 3

A test plate of magnesium alloy of the type AZ 91 having a surface area of 1 dm$^2$ is pickled for 1 minute at room temperature in a 40% hydrofluoric acid.

The test plate treated in this manner is plasma-chemically anodically oxidized in an aqueous/organic chloride-free electrolytic bath of Example 1 at a current density of 4 A/dm$^2$ and an electrolyte temperature of 12° C.±2° C.

The voltage end value of 252 volts is reached after 17 minutes.

The ceramic layer has a thickness of 50 $\mu$m.

EXAMPLE 4

A rod of pure titanium having a length of 30 millimeters and a diameter of 5 millimeters is pickled in a pickle as in Example 2 and is subsequently washed with distilled water.

The rod treated in this manner is plasma-chemically anodically oxidized in an aqueous chloride-free electrolytic bath having the composition

| | |
|---|---|
| a) Cations | 0.2 mol/l calcium ions |
| b) Anions | 0.4 mol/l phosphate |

At a current density of 18 A/dm$^2$ and an electrolyte temperature of 10° C.±2° C.

After a coating time of 10 minutes the voltage end value of 210 volts is reached.

The rod with ceramic layer is washed with distilled water and is dried.

The thickness of the layer is 40 $\mu$m.

EXAMPLE 5

A gear wheel of AlMgSi1 having a surface area of 6 dm$^2$ is degreased and washed with distilled water. An electrolytic bath of Example 1 diluted 100 times with water is used as aqueous/organic chloride-free electrolytic bath which additionally contains 0.1 mol/l each of sodium aluminate and sodium silicate.

The gear wheel is plasma-chemically anodically oxidized at a current density of 10 A/dm$^2$. After a coating time of 120 minutes, a voltage end value of 800 volts is reached.

The gear wheel with ceramic layer is washed and dried. The thickness of the oxide ceramic layer is 130 $\mu$m. The hardness of the ceramic layer is 1900 HV (0.1). The gear wheel coated in this manner has a service life which is 4 times that of a conventionally eloxated gear wheel having the same dimensions.

EXAMPLE 6

An ultrasonic sonotrode of AlZnMgCu1,5 having a surface area of 6.4 dm$^2$ is degreased and subsequently washed with distilled water.

The ultrasonic sonotrode treated in this manner is plasma-chemically anodically oxidized in an aqueous/organic chloride-free electrolytic bath, as described in Example 1, at a current density of 3.5 $A/dm^2$ and an electrolyte temperature of 15° C. After a coating time of 25 minutes, the voltage end value of 250 volts is reached.

Other objects and features of the present invention will become apparent from the following detailed description considered in conjunction with the accompanying drawings. It is to be understood, however, that the-drawings are designed solely for purposes of illustration and not as a definition of the limits of the invention, for which reference should be made to the appended claims.

What is claimed is:

1. An article of aluminum, magnesium, titanium or their alloys comprising a plasma-chemically anodically produced oxide ceramic layer having a thickness from 40 to 150 $\mu$m.

2. The article of claim 1, wherein the thickness of the oxide layer is from 50 to 120 $\mu$m.

3. The article according to claim 1, wherein the oxide ceramic layer comprises corundum.

4. The article according to claim 1, wherein the oxide ceramic layer is produced by carrying out the plasma—chemical anodic oxidation in a substantially chloride—free electrolytic bath having a pH value of 2–8 and a constant bath temperature of −30° to +15° C. and maintaining constant a current density of at least 1 $A/dm^2$ until the voltage reaches an end value.

5. The article according to claim 4, wherein the substantially chloride—free electrolytic bath has less than 5×10 to the −3 mol/l chloride ions.

6. The article of claim 1, wherein the electrolytic bath contains phosphate ions, borate ions and fluoride ions in a quantity of up to a total 2 mol/l, and a stablizer selected from the group consisting of urea, hexamethylenediamine and hexamethylene tetramine, glycol and glycerin in a quantity of up to 1.5 mol/l.

7. An article of Al, Mg, Ti, Ta, Zr, Nb, Hf, Sb, W, Mo, V, Bi or their alloys comprising an oxide ceramic layer having a thickness from 40 to 150 $\mu$m produced by carrying out a plasma-chemical anodic oxidation in a substantially chloride-free electrolytic bath having less than $5\times10^{-3}$ mol/l chloride ions and a pH value of 2–8 and a constant bath temperature of between −30° to +15° C., and maintaining constant in the electrolytic bath a current density of at least 1 $A/dm^2$ until the voltage reaches an end value; the electrolytic bath containing phosphate ions, borate ions and fluoride ions in a quantity of up to a total of 2 mol/l, and a stabilizer selected from the group consisting of urea, hexamethylenediamine and hexamethylenetetramine, glycol and glycerin in a quantity of up to 1.5 mol/l.

8. The article of claim 7, wherein the bath temperature is from −10° to +15° C.

9. The article of claim 7, wherein the bath temperature is maintained constant within limits of ±2° C.

10. The article of claim 7, wherein the voltage has a frequency of up to 500 Hz.

11. An article made of aluminum or its alloys having a wear-resistant oxide ceramic layer having a thickness from 40 to 150 $\mu$m thereon made by carrying out a plasma-chemical anodic oxidation in a substantially chloride-free electrolytic bath containing less than $5\times10^{-3}$ mol/l chloride ions, and phosphate ions, borate ions and fluoride ions in a concentration of 0.01 to 0.1 mol/l and having a pH value of 10 to 12, and maintaining constant a current density of at least 5 $A/dm^2$ until the voltage reaches an end value.

12. The article of claim 11, wherein the pH value of the electrolytic bath is 11.

13. An article of aluminum or its alloys having a wear-resistant oxide ceramic layer of a thickness of from 40 to 150 $\mu$m containing corundum and being produced by a plasma-chemical anodic oxidation.

14. An article of magnesium or its alloys having a wear-resistant oxide ceramic layer of a thickness of from 40 to 150 $\mu$m produced by a plasma-chemical anodic oxidation.

15. An article of titanium or its alloys having a wear-resistant oxide ceramic layer of a thickness of from 40 to 150 $\mu$m produced by a plasma-chemical anodic oxidation.

* * * * *